United States Patent [19]

Ferguson

[11] Patent Number: 5,014,961

[45] Date of Patent: May 14, 1991

[54] SNOW PLOW STAND

[76] Inventor: William H. Ferguson, P.O. Box 103, Nutting Lake, Mass. 01865

[21] Appl. No.: 486,224

[22] Filed: Feb. 28, 1990

[51] Int. Cl.[5] ..... F16M 13/00

[52] U.S. Cl. ..... 248/670; 248/676; 37/231

[58] Field of Search ..... 248/670, 676, 678, 146, 248/149, 152, 176; 172/272, 274, 817; 37/231, 235; 280/475, 481

[56] References Cited

U.S. PATENT DOCUMENTS

| | | | |
|---|---|---|---|
| 1,065,979 | 7/1913 | Spencer | 248/676 |
| 1,450,808 | 4/1923 | Huenergardt | 248/676 |
| 2,524,955 | 10/1950 | Borzell | 248/352 |
| 3,793,752 | 2/1974 | Snyder | 172/413 |
| 4,326,726 | 4/1982 | Dunchock | 248/176 |
| 4,770,304 | 9/1988 | Woods | 212/140 |
| 4,776,115 | 10/1988 | Nicodemus | 37/231 |
| 4,821,435 | 4/1989 | Pester | 37/231 |
| 4,848,717 | 7/1989 | Bevill | 248/670 |

*Primary Examiner*—Ramon O. Ramirez
*Assistant Examiner*—Robert A. Olson
*Attorney, Agent, or Firm*—Richard C. Litman

[57] ABSTRACT

A snow plow support stand provides for the storage of a vehicle attachable snow plow assembly when the plow assembly is not in use. The support stand may be adjusted to support the arms of the plow assembly at the proper height to allow the vehicle operator to position the vehicle for the attachment of the plow assembly without additional assistance. A guide rod may also be adjusted, enabling a single operator to precisely position the vehicle for the attachment or detachment of the plow to or from the vehicle. The support stand provides for adjustment to compensate for different vehicle and plow combinations, and is sufficiently small and light that a single person may place the stand in the bed of a pickup truck or the like which may be used as a snow plow vehicle, and transport the stand to another location at which it may be desired to leave the plow assembly.

8 Claims, 1 Drawing Sheet

SNOW PLOW STAND

FIELD OF THE INVENTION

This invention relates generally to supports and stands for vehicle attachable snow plow assemblies and the like, and more particularly to an adjustable stand allowing quick and easy attachment or detachment of the plow assembly onto or from the vehicle by a single person.

BACKGROUND OF THE INVENTION

Relatively small electrically and/or hydraulically actuated snow plow blade assemblies designed for temporary attachment to pickup trucks and other vehicles of similar size and weight are of course well known. As more and more private roadways and parking areas are constructed for shopping malls, condominiums, Public attractions, etc., more and more of these smaller plows are being used in order to clear such parking areas of snow in lieu of such service by larger municipal, county or state plow vehicles.

It is difficult for most such private operations to justify a single vehicle or fleet of vehicles solely dedicated to use as snow plows. Most such small plows are mounted on pickup trucks, and the trucks are used for a myriad of other purposes when not engaged in the plowing of snow. The additional mass and dimensions of even a small plow mounted on the front of a typical pickup truck is a significant handicap to the utility of such a vehicle for other purposes, resulting in reduced fuel economy, much greater stress and strain on attachment components, frame members and other components at the front of the vehicle, poorer maneuverability, and other problems. Thus, typically such plows are removed when it is anticipated that the plow will not be needed for some period of time, perhaps a day or more.

Even in the case of such a relatively small plow the devices are quite heavy, generally weighing some few hundred pounds. While most of the mass is in the blade area itself, the attachment arms are also quite massive. In order to attach and remove a plow from a vehicle, it is generally necessary for one person to help support the attachment arms of the plow, while another maneuvers the vehicle into proper position and then assists with the attachment of the plow to the vehicle. In many cases, it is difficult to find additional help for this operation, particularly during night or early morning operations when a single vehicle driver may be the only person in the area in order to provide snow removal before others arrive. As can be seen, it often becomes necessary to leave the plow attached to the vehicle in order to allow use under such circumstances, thus handicapping the vehicle for other uses.

What is needed is a stand for the support of a snow plow blade and its accompanying attachment arms, which will support the attachment components properly and thus allow a single person to maneuver the vehicle into position and also to attach the plow to the vehicle without additional help. Such a stand must provide adjustment for different plows and vehicles, and is preferably sufficiently small and light so as to allow carriage of the stand within the bed of a pickup truck which might be used as a plow vehicle. The stand should also provide guidance means for the driver of the vehicle to properly align the vehicle with the plow stand and plow for ease of attachment.

DESCRIPTION OF THE RELATED ART

Various supports and stands are known in the art. For example, Borzell et al. U.S. Pat. No. 2,524,955 discloses a stand intended for the support of an automobile. This stand is formed to support an automobile by acting as an elevated chock for the tire, rather than supporting the frame or other nonrotating assembly as in the case of the present invention. Furthermore, the only vertical adjustment comprises the stacking of a plurality of stands one above the other; the relatively fine adjustment required to accomplish the function of the present invention cannot be achieved by this device.

Snyder U.S. Pat. No. 3,793,752 discloses a snow plow apparatus which includes hydraulic jacks which may elevate the blade while in use, thereby providing adjustment for different conditions. It might appear that if the blade apparatus were removed from the plow vehicle, the hydraulic jacks could be used to support the attachment arms of the blade apparatus while the blade rested on a surface. However, this would require hydraulic pressure to be maintained in the jack cylinders, which pressure over a period of time will slowly bleed off, thus allowing the attachment arms to lower to the surface. This is a continuing problem with many hydraulic systems. In fact, it is standard procedure for operators of hydraulically controlled plows to release all hydraulic pressure in the system when the plow vehicle is parked, thus allowing the plow blade to lower to and rest upon the surface when not in use in order to preclude additional wear and tear on seals and other components in the hydraulic system. Furthermore, the added complexity of the additional hydraulic circuitry necessary to accomplish the desired function of the device of the Snyder patent adds to the cost and maintenance requirements of such a plow apparatus, and also requires that hydraulic fittings be attached and detached each time the plow apparatus is fitted to or removed from the plow vehicle.

Various other supports, lifts and stands are known, such as the hoist disclosed by Woods U.S. Pat. No. 4,770,304. This device is actuated by means of a mechanical cable system, and while adaptable to perform the function of the present invention, would require the operator of a plow vehicle to perform an extra operation. The operator would have to leave the controls of the vehicle and attach the lifting cable to the plow assembly in some manner, lift the plow attachment arms, and finally connect or disconnect the attachment arms from the vehicle in whatever order is appropriate. The present invention allows the operator to position the plow assembly on the stand by means of the guide, lower the plow, and finally leave the controls of the vehicle and detach the plow assembly, or reverse the operation to reattach the plow to the vehicle. Once the stand of the present invention is adjusted for a given plow and vehicle, no further adjustment of outside lifting apparatus need be accomplished; the operator need only leave the cab or controls of the vehicle once in order to attach or detach the plow. Moreover, none of the devices of the patents noted above disclose guide means allowing the operator of a vehicle to position that vehicle relative to a stationary stand or lifting device, as does the present invention.

None of the above noted patents, either singly or in combination, are seen to disclose the specific arrangement of concepts disclosed by the present invention.

SUMMARY OF THE INVENTION

By the present invention, an improved stand for the support of a vehicle attachable snow plow apparatus or the like is disclosed.

Accordingly, one of the objects of the present invention is to provide for a plow stand allowing for ease of attachment of such a plow apparatus to the plow vehicle.

Another object of the present invention is to provide for a plow stand which is adjustable for different plow and vehicle combinations.

Yet another object of the present invention is to provide for a plow stand which incorporates guide means allowing for the accurate placement of a plow apparatus upon the stand by an operator driving the plow vehicle.

Still another object of the present invention is to provide for a plow stand which is relatively light weight, portable and capable of being placed and transported within the bed of a typical pickup truck which may be used as a plow vehicle.

An additional object of the present invention is to provide for a plow stand which provides greater stability to the plow apparatus placed thereupon, lessening the tendency for such a plow apparatus to tip forward as the attachment arms are raised.

A further object of the present invention is to provide for a plow stand which is relatively easy to assemble and which may be easily disassembled and contained in a small volume when disassembled.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
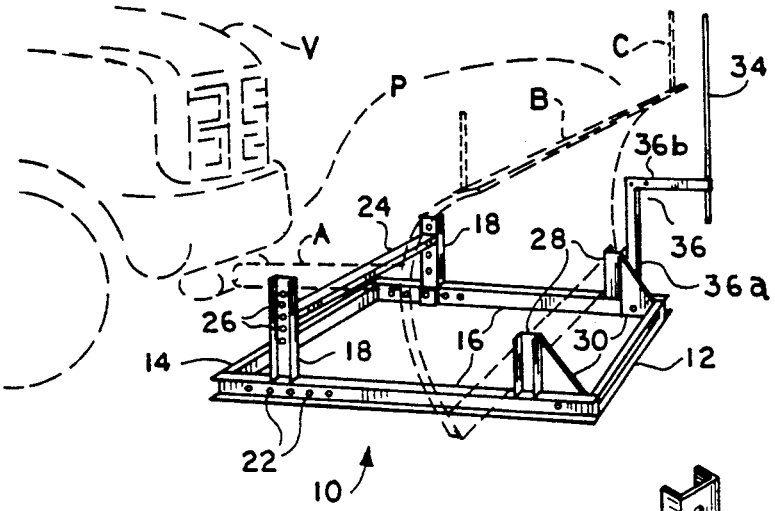
FIG. 1 is a perspective view of the stand as it might be used for the support and/or storage of a plow apparatus and typical plow vehicle.
Figure 2:
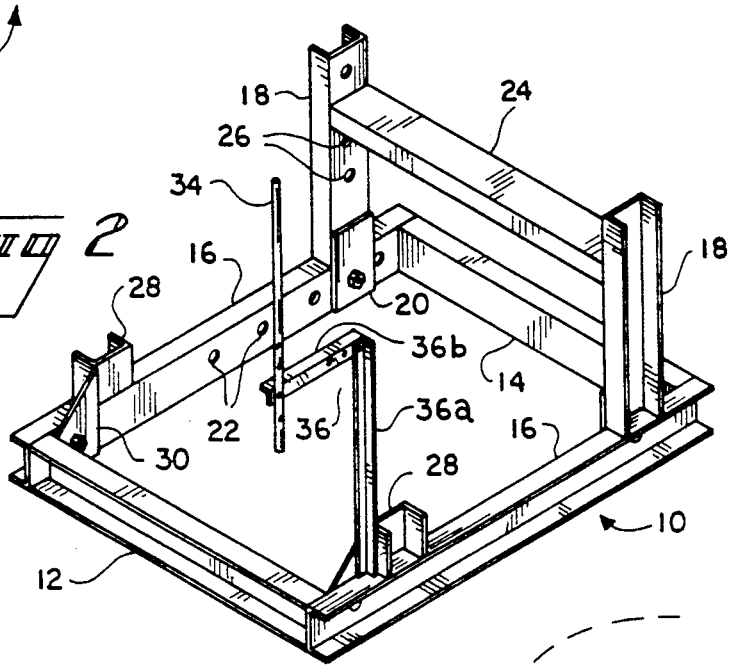
FIG. 2 is a perspective view of the plow stand, showing the various features of the stand.

Referring now to the drawings, particularly FIG. 1, the present invention will be seen to relate to an improved stand 10 for the support and storage of a snow plow apparatus as may be used by many light utility vehicles, such as pickup trucks, for clearing snow. Stand 10 basically comprises a forward crossmember 12, rear crossmember 14, and two side members 16 which in their assembled state form a rectangular base. Members 12, 14 and 16 forming the base may be of U cross section steel channel as shown in the drawings, or alternatively of square or rectangular cross section steel tube or of any other suitable material. Members 12, 14 and 16 may be welded, bolted or otherwise securely fastened together.

A vertical support 18 is secured to the rear of each side member 16 by means of an attachment plate 20. Plates 20 may be bolted, welded or otherwise attached to supports 18, but are preferably bolted to side members 16 through one of a number of holes 22 provided in side members 16 for adjustment and/or assembly/disassembly. This adjustment or attachment feature provides for the support of various plows with attachment arms of differing lengths, as well as allowing the support stand itself to be shipped or stored in a relatively small space.

A horizontal support member 24 is bolted between the two vertical supports 18 by means of the holes 26 provided. A flange, not shown, may be placed in each end of horizontal support member 24 in order to receive an attachment bolt to secure member 24 to supports 18. By providing a plurality of holes 26 in vertical members 18, the height of horizontal member 24 may be adjusted for different plow and plow vehicle combinations.

Figure 3:
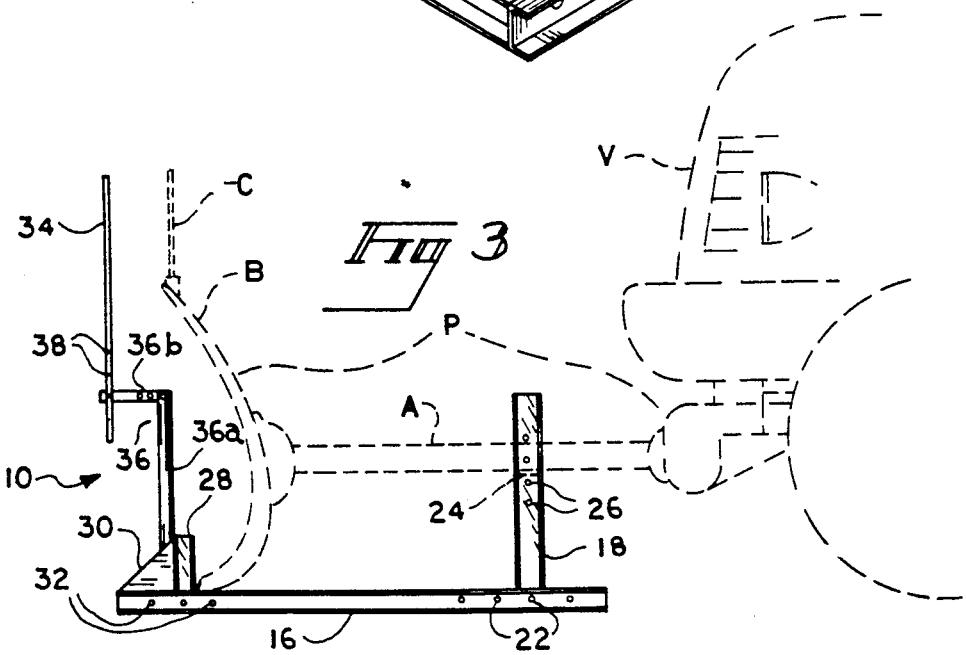
FIG. 3 is a side view of the stand.

A blade stop 28 is installed near the front of each side member 16. Each blade stop 28 may be further supported by a gusset 30 in order to help prevent a plow blade B from dislodging blade stop 28 as plow vehicle V is maneuvering. While normally a blade stop 28 and gusset 30 would be installed in one location near the forward end of each side member 16, some adjustment may be provided by means of a plurality of holes 32 in each side member 16 as shown in FIG. 3, similar to the means provided for attaching vertical members 18 to side members 16.

Typically a plow blade B will be equipped with a clearance marker rod C at each end. By equipping stand 10 with a similar guide rod 34, the plow blade B may be accurately maneuvered into position to rest on stand 10. A guide rod support 36, comprising a vertical member **36*a* and a horizontal member 36*b*, is used to support guide rod 34 at one forward corner of stand 10. Guide rod support 36 may be attached to a blade stop 28 or directly to a side member 16. Guide rod 34 may be adjusted vertically by means of a plurality of adjustment holes 38, and horizontal member 36*b*** may be adjusted in a like manner for proper positioning if desired.

In order to use stand 10, it will be necessary to adjust various components to optimally support any given plow assembly P. This may be accomplished by maneuvering vehicle V with plow assembly P attached into position so that the lower edge of blade B is abutting the rear of blade stops 28 on stand 10. Any pressure in the plow operating system may then be released, thus establishing an "at rest" position for the plow assembly P on stand 10. Horizontal and vertical adjustment of guide rod 34 may then be completed in order to match the location of guide rod 34 with any clearance marker rod C attached to blade B, and horizontal support member 24 may be adjusted to support plow attachment arms A. Once these steps have been accomplished the stand will be ready for use, and a single operator may attach and detach the plow assembly P from the vehicle V without further assistance by others. The use of the stand 10 by a different vehicle V and/or plow assembly P may require readjustment of the components as described above.

Stand 10 may be placed at any location convenient for the storage of a plow assembly P, and may be bolted or otherwise secured to the underlying surface if so desired. A person wishing to store a plow assembly P on the stand 10 may do so by raising the plow blade B as the vehicle V approaches the stand 10 in order that the blade B will clear the support members 18 and 24, and continue to drive the vehicle V forward while lowering the blade B once the blade B is forward of support members 18 and 24. When a clearance rod C on blade B is seen to line up with guide rod 34, the vehicle V is stopped and all remaining pressure released from the blade operating system in the vehicle V. At this point, the lower edge of blade B will be abutting the rear of blade stops 28, while plow assembly arms A will be resting upon horizontal member 24 of the stand 10. The driver of the vehicle V may then detach any attachment bolts or pins, chains, and/or hydraulic lines between vehicle V and plow assembly P and back the vehicle V away, thus leaving the plow assembly F stored upon stand 10 and ready to be reattached to vehicle V when the need arises. A single person may ready the plow assembly for use by driving the plow vehicle v into position, attaching any bolts, pins, chains, hydraulic lines, etc., operating the plow controls to lift plow blade B in order to clear the stand 10, and backing the vehicle V away from stand 10.

Stand 10 as described is seen to be sufficiently small and light that the operator of a plow vehicle V may pick up stand 10 and place it within the bed of a pickup truck or the like for transport from place to place. If a pickup truck is used as the plow vehicle V as is often the case, the operator may attach the plow assembly P to the vehicle V, maneuver the vehicle V and attached plow assembly P to clear stand 10, and store stand 10 in the bed of the plow vehicle V while the plow is in use. Thus, if it is desired to detach the plow assembly P from the vehicle V and store it at a different location, the operator may easily do so.

It is to be understood that the present invention is not limited to the sole embodiment described above, but encompasses any and all embodiments within the scope of the following claims.

I claim:

1. A support stand for the storage of vehicle attachable snow plow assemblies, said support stand comprising;

a base of generally rectangular form, said base comprising a forward crossmember, a rear crossmember, and two side members, each of said side members having a vertical support attached to and extending upward from the rear portion of each of said side members, said vertical supports containing a horizontal support extending therebetween, each of said side members containing a blade stop attached to the forward portion of each of said side members, at least one of said blade stops supporting a guide rod support assembly extending upward therefrom, and the upper extremity of said guide rod support assembly supporting a guide rod.

2. The support stand of claim 1 wherein;

the location of said vertical supports is adjustable on said side members.

3. The support stand of claim 1 wherein;

the height of said horizontal support is adjustable.

4. The support stand of claim 1 wherein;

the position of said blade stops is adjustable on said side members.

5. The support stand of claim 1 wherein;

the position of said guide rod is adjustable on said guide rod support assembly.

6. The support stand of claim 1 wherein:

the components comprising said base, said vertical supports, said horizontal support, and said blade stops are formed of steel channel of a generally U-shaped cross section.

7. A method of using the support stand of claim 1 comprising the following steps:

maneuvering a vehicle carrying said vehicle attachable snow plow assembly into a position approaching the rear of said support stand, raising the blade of said plow assembly to a sufficient height to clear said vertical support members and said horizontal support member, proceeding forward with said vehicle in order to position said blade over the approximate center of said support stand, lowering said blade to contact or nearly contact said side members of said support stand, proceeding further forward with said vehicle until said blade contacts one or both of said blade stops, adjusting the height of said horizontal support member as necessary to support the arms of said plow assembly, adjusting said guide rod support assembly as necessary to align said guide rod as desirable, and removing all attachments and connections between said vehicle and said plow assembly.

8. A method of using the support stand of claim 1 comprising the following steps:

maneuvering a vehicle into position approaching the rear of said support stand supporting a vehicle attachable snow plow assembly, positioning said vehicle in order to secure said plow assembly to said vehicle.

raising said plow assembly to a height sufficient to clear said vertical members and said horizontal member of said support stand, and maneuvering said vehicle rearward a sufficient distance to clear said support stand.

* * * * *